US005119643A

United States Patent [19]

Conley et al.

[11] Patent Number: 5,119,643

[45] Date of Patent: * Jun. 9, 1992

[54] CONNECTION ASSEMBLY AND COMPOSITE THEREFOR

[76] Inventors: James P. Conley, 2816 Page St., Ann Arbor, Mich. 48104; William E. Cowan, Rd. 1, Box 26K, Morgantown, Pa. 19343; Douglas L. Heydt, 200 Stanford Ave., West Lawn, Pa. 19609

[ * ] Notice: The portion of the term of this patent subsequent to Apr. 26, 2005 has been disclaimed.

[21] Appl. No.: 631,410

[22] Filed: Dec. 21, 1990

Related U.S. Application Data

[63] Continuation of Ser. No. 464,930, Jan. 16, 1990, abandoned, which is a continuation of Ser. No. 152,929, Feb. 5, 1988, abandoned, which is a continuation of Ser. No. 70,968, Jul. 8, 1987, Pat. No. 4,739,635, which is a continuation of Ser. No. 873,076, Jun. 2, 1986, abandoned, which is a continuation of Ser. No. 567,654, Jan. 3, 1984, abandoned.

[51] Int. Cl.[5] ..... D04B 7/12

[52] U.S. Cl. ..... 66/190; 66/85 A; 66/194; 2/DIG. 6

[58] Field of Search ..... 66/190-193, 66/85 A; 2/DIG. 6

[56] References Cited

U.S. PATENT DOCUMENTS

| | | | |
|---|---|---|---|
| 2,331,290 | 10/1943 | Amidon | 66/191 |
| 3,174,308 | 3/1965 | Mauersberger | 66/194 X |
| 3,266,841 | 8/1966 | Altman | 2/DIG. 6 |
| 3,367,333 | 2/1968 | Schweier | 66/85 A |
| 3,368,563 | 2/1968 | Scheier | 66/85 A |
| 3,531,953 | 10/1970 | Hutto et al. | 66/192 |
| 3,600,259 | 8/1971 | Smith et al. | 66/192 X |
| 3,603,117 | 9/1971 | Svoboda | 66/183 |
| 3,722,442 | 3/1973 | MacIsaac et al. | 66/85 A |
| 3,943,981 | 3/1976 | DeBrabander | 2/DIG. 6 |
| 4,298,543 | 11/1981 | Miyagawa et al. | 66/192 X |
| 4,404,999 | 9/1983 | Woodall et al. | 139/391 |
| 4,450,196 | 5/1984 | Kamat | 66/193 X |
| 4,454,183 | 6/1984 | Wollman | 428/92 |
| 4,624,116 | 11/1986 | Rogers | 66/193 |
| 4,739,635 | 4/1988 | Conley et al. | 66/190 |

FOREIGN PATENT DOCUMENTS

| | | | |
|---|---|---|---|
| 91273 | 12/1983 | European Pat. Off. | 66/85 A |
| 1585449 | 10/1969 | Fed. Rep. of Germany | 66/85 A |
| 1302582 | 3/1972 | Fed. Rep. of Germany | 66/192 |
| 2452572 | 5/1975 | Fed. Rep. of Germany | 66/193 |
| 147696 | 4/1981 | Fed. Rep. of Germany | 66/85 A |
| 37378 | 3/1963 | German Democratic Rep. | 66/85 A |
| 42872 | 11/1965 | German Democratic Rep. | 66/85 A |
| 672248 | 7/1979 | U.S.S.R. | 66/85 A |

OTHER PUBLICATIONS

Bahlo, "New Fabrics Without Weaving", Modern Textiles Magazine, Nov. 1965, pp. 51 to 55.

Velcro Corp. Publication "Molded Hook Tapes" Sep. 1972.

*Primary Examiner*—Andrew M. Falik
*Assistant Examiner*—John J. Calvers
*Attorney, Agent, or Firm*—Dority & Manning

[57] ABSTRACT

An improved male-female type connector assembly. A male connector includes hook elements while a female connector includes a composite of a flexible substrate having a knit structure with loops produced about at least a portion of same. Loop weight, loop density and/or configuration of the hook elements may be varied to produce an assembly that is intended for repetitive connective, disconnect operations, or a semi-permanent structural connection.

8 Claims, 3 Drawing Sheets

CONNECTION ASSEMBLY AND COMPOSITE THEREFOR

This is a continuation of Ser. No. 464,930, filed Jan. 16, 1990, now abandoned, filed in the name of James P. Conley et al., entitled "Connector Assembly and Composite Therefor", which is a continuation of Ser. No. 152,929, filed Feb. 5, 1988, abandoned, which is a continuation of Ser. No. 070,968, now U.S. Pat. No. 4,739,635, filed Jul. 8, 1987, which is a continuation of Ser. No. 873,076, filed Jun. 2, 1986, abandoned, which is a continuation of Ser. No. 567,654, filed Jan. 3, 1984, abandoned.

BACKGROUND OF THE INVENTION

The present invention relates to an improved male-female type connector assembly as exemplified by the hook and eye type connector sometimes referred to as "Velcro" fasteners, and to composites for use as the female component of same.

Since the advent of the "Velcro" type connector assemblies, where monofilament hook elements are brought into intermeshing engagement with a mat of multifilaments, numerous modified assemblies have been produced along the same general format. Commonly the male and female type connectors are secured to particular elements that are intended to be removably connected thereby such that, once connected, a predetermined, light holding power is achieved while at the same time disconnect is accomplished by overcoming the resistance of the engagement between the hooks and the multifilament female connectors to manually separate same. For such connector assemblies, repetitive connect, disconnect operations are possible without adversely affecting holding power of the assembly.

In general, prior male-female "Velcro" type connector elements as described above have been intended for non-structural applications in which ease of separation of connector elements is present, or in other words a low degree of holding power is produced between the hooks and the multifilament receivers. Connector assemblies of the present invention may be designed to be employed in non-structural applications where repetitive connect, disconnect of the elements is anticipated, or in applications where a greater holding power is dictated for at least a semi-permanent securement and where once the elements are associated or connected, if improperly placed, disassociation is possible to permit proper alignment and reconnection though at some expense to the female composite. Particularly, with connector assemblies according to the present invention, the holding power between the male and female elements may be such that once the elements are interengaged, separation is achieved only with difficulty, permitting employment of same for structural end uses in which at least a semi-permanent installation is anticipated.

SUMMARY OF THE INVENTION

It is an object of the present invention to provide an improved connector assembly of male and female elements.

Another object of the present invention is to provide an improved connector assembly for structural end uses in which hook elements are interengagable with knit loop structures of a composite.

Yet another object of the present invention is to provide a two piece connector assembly utilizing male hook elements and a female textile composite which includes knit loop structures such that when the two connector elements are pressed together, a holding relationship is established, and which holding relationship may be varied to achieve a semi-permanent connection or a connection that is intended for repetitive connect, disconnect operations.

Still further another object of the present invention is to provide an improved connector assembly of the hook-eye type which is capable of greater holding power than systems presently available.

Yet another object of the present invention is to provide an improved composite having knitted loop structures for use as a female connector element for receipt of hook type connector elements to achieve a semi-permanent structurally sound relationship, or a connect, disconnect relationship, as determined by the hooks and/or the composite.

Another object of the present invention is to provide an improved connector assembly by which structural elements may be secured to adjacent structural elements in a structurally sound, but releasable relationship.

Generally speaking, the connector assembly according to teachings of the present invention comprises a plurality of male hook means and a female means adapted to receive said male hook means in a predetermined degree of releasable securement, said female means comprising a flexible substrate, said substrate having a knit structure produced about at least a portion of same, said knit structure including a plurality of loops, said loops being of a predetermined height and being present in a predetermined density to achieve said degree of holding power when interengaged with said male hook means whereby when said male hook means are pressed against said female means, said hook means become interrelated with said loops to achieve releasable securement therebetween that has a predetermined strength.

More specifically, connector assemblies according to the present invention include male hook type elements and a female composite receiving means, both of which are in turn unifiable to further elements to be connected thereby. For example, in the automotive industry one of the two connector elements, preferably the female composite may be securable to a foam headliner with the other of the connector elements being securable to the underside of the roof of the automobile such that when the headliner is pressed against the underside of the roof, the hook elements will become securely interrelated with the loops of the female composite and secure the headliner in place. In like fashion, similar arrangements may be made with other automotive components where structural securement of a relatively high holding power is appropriate, as exemplified by seat portions, arm rests, carpeting and the like. As set forth herein, while a structural type connector assembly is most preferred according to teachings of the present invention, by variation of the configuration of the hook means and/or the female composite, an assembly may be produced that will tolerate the conventional repetitive connect, disconnect operations.

Specifically as to female composites according to the present invention, same may be produced on a knit stitch machine where a flexible backing material or substrate is fed to the machine with a knit fabric being produced about the substrate which includes the loops on one or both sides of the substrate. While any flexible substrate may be utilized according to the teachings of the present invention that provides the needed strength and stability, textile materials such as woven fabrics, knit fabrics, non-woven sheets, or the like are preferred, with an open scrim material being most preferred. An open scrim substrate supplies strength and stability necessary for use of the assembly for structural uses and may be approximately matched to the gauge of the knit stitch machine to generally locate the loops within the interstices of the scrim. When utilizing a flat knitting yarn, the yarn due to its surface characteristics follows the needles, whereby loops will be produced on both sides of the substrate, with approximately half of the loops on each side. With a textured yarn, the bulk of same somewhat precludes yarn following the needles as noted above, whereby generally all of the loops are produced on one side of the substrate only. Furthermore when utilizing a textile composite according to teachings of the present invention, the male hook elements may become interengaged not only with the loops, but with adequate compression at the time of interengagement or subsequent thereto, the hook structures may in fact pierce the substrate, and even a further layer secured to the underside of the composite, both of which provide yet further improved holding power between the components of the assembly.

In general the term semi-permanent connection as referred to herein refers to a structurally sound connection which may be broken a limited number of times for realignment of the components, replacement of a component or the like. As set forth herein, however, by control of loop density and/or loop height and/or configuration of the hook means, an assembly may be provided that is intended for repetitive use or a low holding power relationship. During the disconnection of the elements intended for structural use, some damage will generally occur to the female component particularly the loops, which will not adversly affect a second connection. Repeated connection and disconnection of such connector elements, however, will ultimately destroy the female composite as an effective connector element.

DESCRIPTION OF THE PREFERRED EMBODIMENTS

Figure 1:
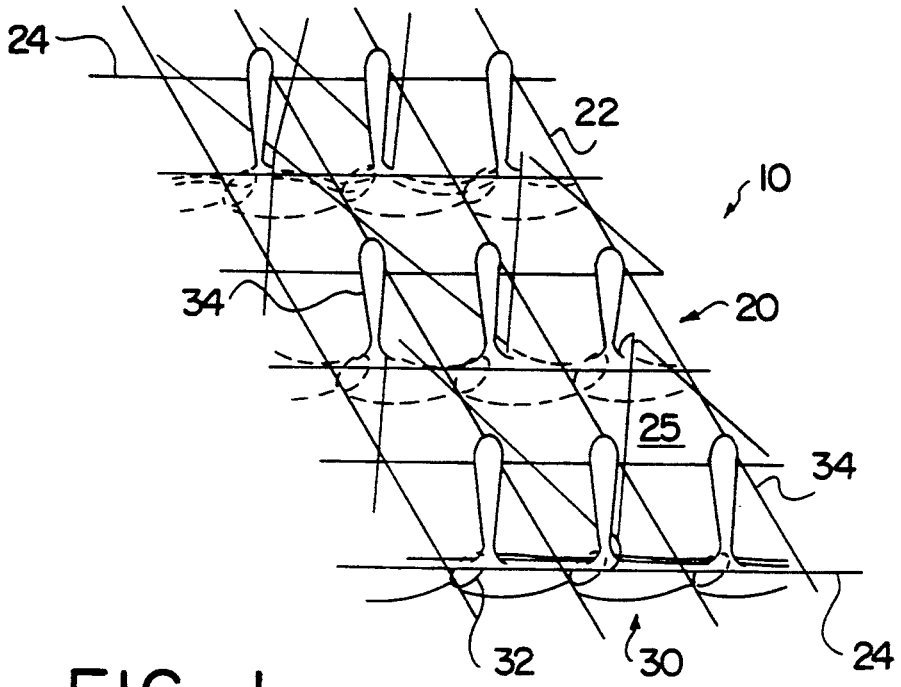
FIG. 1 is a partial schematic illustration of a portion of a scrim fabric substrate having a knit structure incorporated therewith according to teachings of the present invention.
Figure 2:
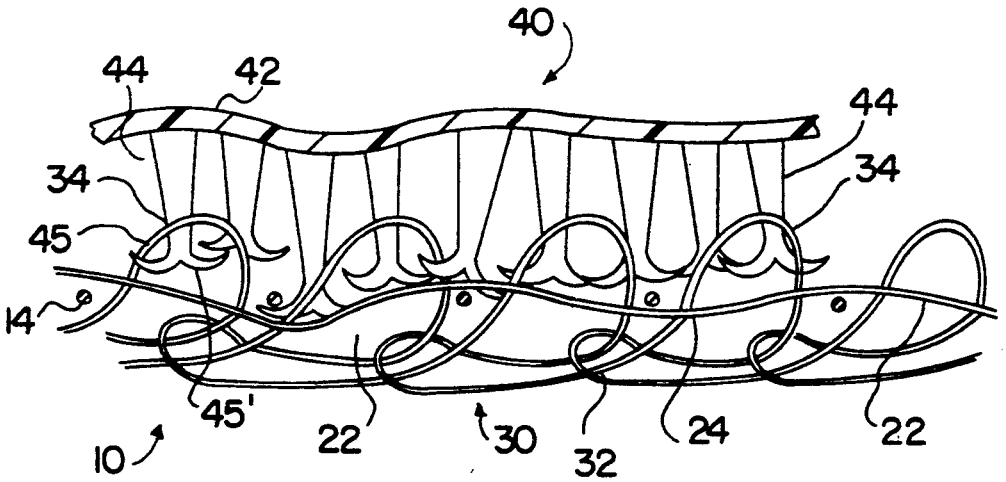
FIG. 2 is a partial schematic cross sectional view of a connector assembly according to teachings of the present invention illustrating male hook elements interengaged with a textile composite.

Making reference to the drawings, preferred embodiments of the present invention will now be described in detail. FIGS. 1 and 2 schematically illustrate a preferred embodiment of a connector assembly according to the teachings of the present invention. In FIG. 1, a female composite generally indicated as 10 is schematically illustrated that serves as the female portion of the connector assembly. In FIG. 2, a composite generally 10 is illustrated having a male hook means generally 40, that serves as the opposite portion of the assembly, interrelated therewith to schematically illustrate connection of the present assembly. Composite 10 includes a flexible substrate generally 20 that has a knit structure generally indicated as 30 produced about a predetermined portion of same. Particularly, while the knit structure may be produced across the entire surface of substrate 20, in like fashion, knit structure 30 may be provided in spaced apart rows, or otherwise as desired. Such, as will be described in more detail hereinafter, serves as the female portion for a hook-eye type connector assembly similar to the standard "Velcro" system, but is capable of both repetitive removable securement or semi-permanent securement, depending upon the design of the components.

Flexible substrate 20 of female composite 10 may be any desired type of material that will perform according to the intended use of same, and is exemplified by woven fabrics, knit fabrics, non-woven sheets, paper, polymeric film, and the like. Preferably flexible substrate 20 includes interstices or openings therein in which loops 34 of the knit fabric 30 produced thereabout may be placed. Most preferably, a woven or non-woven scrim is utilized which is light weight and very open in nature, and which affords good strength and stability to the composite.

The knit structure 30 of composite 10 is produced on flexible substrate 20 as substrate 20 is being fed beneath the knitting needles. Knit structure 30 is thus actually incorporated into substrate 20. While a number of different machines may be employed to produce the female composites according to the present invention, knit-stitch machines exemplified by Malimo machines and Arachne machines are preferred. As illustrated in FIG. 1, and in a most preferred arrangement, the openness of substrate 20, such as a woven scrim may be predetermined to approximate the gauge of the knit stitch machine such that the loops 34 produced during the knitting process are generally located within the openings or interstices 25 of scrim 20. In such fashion, as noted above, a textured polymeric knitting yarn will produce loops 34 atop substrate 20 while a flat polymeric yarn will produce loops 34 above and below substrate 20. In producing knit structure 30 about substrate 20, any knit stitch may be utilized that is capable of producing the required loops 34. Preferably a tricot stitch is utilized. Since utilization of machines e.g. knit-stitch machines for producing a knit structure with loops is well known to those skilled in the art, a typical machine is not illustrated. Suffice it to say that substrate 20 is fed to the knit stitch machine, preferably from a roll source with the knitting yarns being fed to the knitting needles. The knitting needles are manipulated according to a control mechanism to generate the particular knit structure 30 such that the stitches 32 are produced about flexible substrate 20 with the loops 34 being produced around sinkers and being positioned generally within interstices 25 defined by the longitudinal and transverse elements 22 and 24 of substrate 20, or elsewhere.

Making specific reference to FIG. 2, the holding relationship between the male and female portions of the connector assembly according to the present invention is schematically illustrated. A cross sectional view of a fabric composite of the type illustrated in FIG. 1 is shown in FIG. 2 with the male connector portions interengaged therewith to create a securement therebetween. The male connector component 40 includes a substrate 42 having a plurality of elongated hook elements 44 secured thereto, the outer free ends of which possess hook tips 45, 45' extending from opposite sides of same. Such a configuration is sometimes referred to as an "anvil" hook, though same is not to be construed as limiting. As the hook means 40 is pressed against female composite 10, the hook tips 45, 45' pass beneath an upper level of loops 34 due either to deflection of the loop yarn or the hook tips or both, to become interengaged therewith. Thereafter should one attempt to separate the elements it becomes necessary to either rupture loop 34 or deflect hook tips 45 or 45' adequate to permit passage around loops 34. As is illustrated in FIG. 2, utilizing an open substrate, such as a scrim enables the hooks 44 to likewise pass through same such that once the hook tips 45, 45' reside on the underside of the substrate 20, tips 45, 45' may engage warp or fill elements 22, 24 respectively of scrim 20 or loops on the underside of the substrate, if present to further increase holding power of the connection. Still further, in the event a further layer of material is laminated or otherwise affixed to an underside of substrate 20 (See FIG. 3), male hook elements 44 may even become interengaged therewith upon adequate force to still further increase the holding power of the connection.

Figure 3:
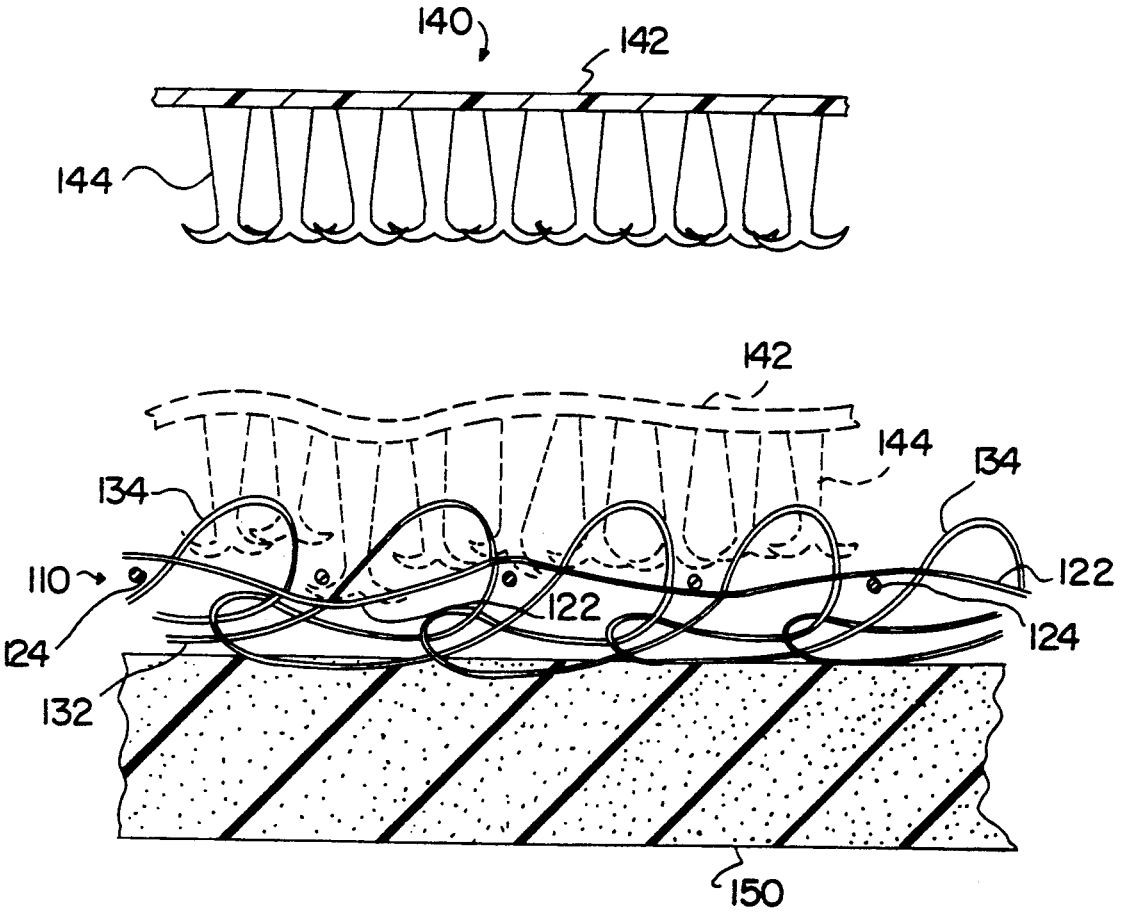
FIG. 3 is further partial schematic cross sectional view of a connector assembly according to the present invention illustrating a further embodiment of same.

With specific reference to FIG. 3, a further embodiment of the present invention is illustrated in which a female composite generally 110 includes a flexible substrate 120 with a knit fabric 130 produced thereabout. Knit loops 134 are produced during knitting of the fabric and extend upwardly from a top surface of substrate 120 while a further layer such as a foam component 150 is secured to an underside of substrate 120 according to conventional techniques such as by way of an adhesive, flame bonding or the like. As shown in FIG. 3, foam layer 150, by way of example, could represent a portion of a headliner for an automobile, padding for a seat, an arm rest or the like which is intended to be appropriately secured within the vehicle. Hence with male connector 140 secured at a location where foam element 150 is to be secured, and with foam element 150 having a female composite 110 secured to a desired underside area, once foam element 150 is pressed against the male hook portion 140, the hook elements 144 become interengaged with loops 134, elements 122 and 124 and/or foam element 150 to securely fasten foam element 150 in place.

Obviously while as illustrated in FIG. 3 a foam layer 150 is secured to female portion 110 of the connector assembly, it should be obvious to one skilled in the art that the further layer represented by the foam layer 150 could be any particular material as desired that may be fixed to the composite 110 as exemplified by various polymeric materials, metal, additional fabrics, foam, or the like. Likewise the further layer 150 could be secured to the male connector component and the female component secured to the mount location.

Figure 4:
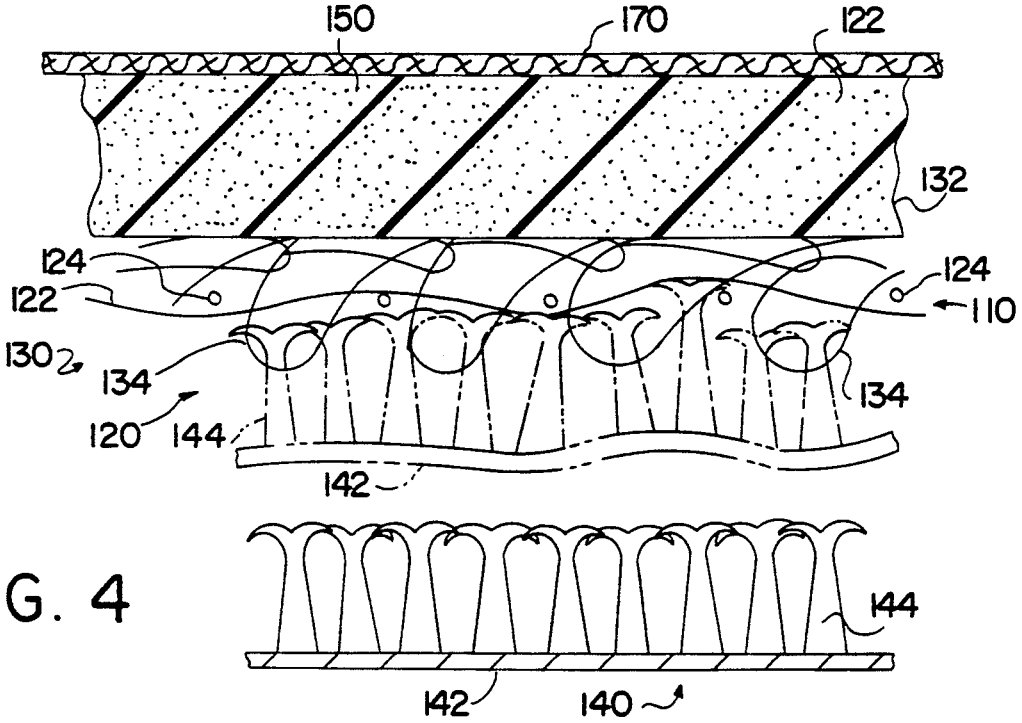
FIG. 4 is a further partial schematic cross-sectional view of a connector assembly according to the present invention illustrating a further embodiment of same.
Figure 5:
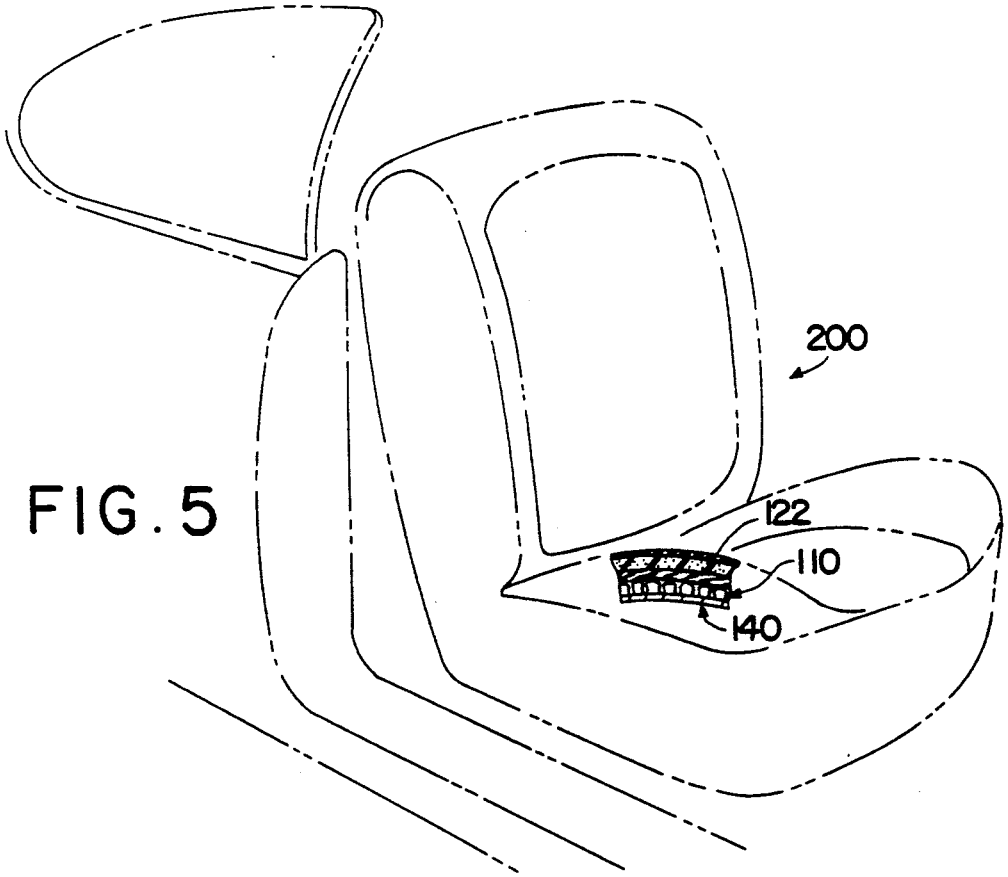
FIG. 5 is a schematic illustration of the embodiment of the present invention as illustrated in FIG. 4 in a seating environment.

FIG. 4 illustrates and embodiment of the present invention as illustrated in FIG. 3 with a fabric covering 170 secured to the foam layer 150. Such a composite could, as noted above, be employed in the automotive environment for seats, headliners and the like. FIG. 5, in fact, schematically illustrates an outline of a seat generally such as might be employed in an automobile with a connector assembly as illustrated in FIG. 5 employed therewith.

The following examples are set forth for a better understanding of the present invention.

EXAMPLE 1

A woven scrim fabric substrate was fed to a Malipol type machine. The scrim had 14 picks per inch, 25 warp ends per inch and a basic weight of 1.4 ounces per square yard. Texturized polyester yarn (150 denier) was fed to the knitting needles. Machine settings included; needle eccentric, 17 mm; closing wire eccentric, 9.6 mm; guide bar swing, 9.6 mm; "S" gap (space between guide bar and turn over sinker), 7 mm; stitch pattern notation, 1-0, 1-2 (tricot); courses per inch, 1100; stitch length, 1.6 mm and loop height, 5 mm. Fabric produced according to the above parameters produced a composite having a loop density of approximately 225 loops per square inch. When pressed against a strip measuring about 1"×4" of hook elements of the type depicted in the Figures, a firm connection was realized. With some difficulty, the strip of hook elements could be separated from the fabric. Damage to the loops was evident after separation, but a further connection was successful.

EXAMPLE 2

Example 1 was repeated with the exception that loop height was reduced to 3 mm, and a foam layer was secured to an underside of the scrim. Post heat treatment of the composite caused some loop shrinkage, and a successful connection with the hook elements could not be achieved.

EXAMPLE 3

Example 1 was repeated with the exception that a number of further backing materials were fed to the machine beneath the scrim, including a woven fabric, a knit fabric, and a non-woven sheet. In each case a successful composite was produced which due to the backing provided a stronger composite having a solid appearance.

EXAMPLE 4

Example 1 was repeated with the exception that certain of the machine settings were changed to the following: "S" gap, 4.5 mm; loop height, 3 mm; and stitch length, 1.2 mm. The composite produced yielded a loop density of approximately 250 to 280 loops per square inch. When pressed against the loops, a relatively easily releaseable securement was achieved, with significantly less holding power than the composite of Example 1, and without any significant damage to the loops after separation of the hook elements.

EXAMPLE 5

Example 1 was repeated except that the scrim substrate was omitted. The knit fabric produced did not possess adequate strength or stability to afford a structurally secure interengagement with the hook elements.

Obviously depending upon the particular intended in use of the connector assembly, the above examples are not inclusive and the machine settings as well as the substrate and knitting yarn may be varied to match a particular connector assembly for a particular end use as to the required degree of holding power, the likelihood of repetitive connect, disconnect, and the like. As mentioned above, the assembly of the present invention can be varied to be suitable for different end uses. For example loop height should generally fall in a range of from about 3 to 5 millimeters while loop density should fall in a range of from about 100 to about 700 loops per square inch. While no specific parameters are now available to dictate the specific loop height and density for a particular end use, the higher loops and greater loop density lend themselves to permanence while shorter loops and less dense loops lend themselves to ease of separation. As shown in Example 4, a loop density similar to that of Example 1 was appropriate for the repetitive connection when the loop height was reduced to 3 mm. Thus proper combinations may yield the desired holding powder.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A connector assembly comprising:

a) a male hook means, said male hook means comprising a substrate having a plurality of elongated elements secured thereto and extending outwardly therefrom, said elongated elements having hooks at outer free ends of same; and b) female means for receiving said male hook means in a predetermined degree of releasable securement, said female means comprising an independent flexible substrate, said substrate having a stitch bond knit structure of formed pile loops located above said independent substrate in a density of from about 100 to about 700 loops per square inch and a loop height of from about 3 to about 5 millimeters, whereby said male hook means interengage with said loops to form said predetermined degree of securement.

2. A connector assembly as defined in claim 1 wherein said flexible substrate for said female means is a woven scrim.

3. A connector assembly as defined in claim 2 wherein said woven scrim has approximately 14 picks per inch and approximately 25 warp threads per inch and wherein said knit structure is a tricot knit of texturized polyester yarns.

4. A female receiver means for a connector assembly in which male hook means are securable thereto comprising an independent woven scrim, said scrim having a stitch bond knit structure including a plurality of loops as a component thereof extending outwardly from said scrim for a loop length in a range of from about 3 to 5 millimeters, said loops being present in a density of from about 100 to about 700 loops per square inch such that when said male hook means are pressed against said female receiver means, said hook means and said elements of female receiver means become interengaged to produce a predetermined degree of securement therebetween.

5. A connector assembly for use in automobiles, in seats and the like comprising:

a) a male hook means, said male hook means comprising a substrate for securement to a surface, and a plurality of elongated hook elements secured thereto and extending outwardly therefrom; and b) female receiver means securable to said male hook means, said female receiver means comprising an open woven scrim having longitudinal and transverse elements defining interstices therebetween, said scrim having a stitch bond knit structure produced thereabout, said knit structure including a plurality of loops located at interstices of said scrim and extending thereabove, said loops having a height and a density of from about 100 to about 700 loops per square inch to achieve a predetermined degree of securement with said male hook means, one of said male or female means further having a layer of a foam secured thereto.

6. A female receiver means for use in an automotive seat for securement thereat to a substrate having a plurality of elongated hook elements secured thereto and extending outwardly therefrom comprising:

a woven scrim having a plurality of spaced apart warp yarns and a plurality of spaced-apart fill yarns interlaced therethrough, said warp and fill yarns cooperating to define interstices therebetween, said scrim having a separate stitch bond knit structure produced thereabout, said knit structure including a plurality of loops as a component thereof, said loops having a loop length of from about 3 to 5 millimeters and being present in adequate density that when said receiver means is brought into engagement with said substrate having said elongated hook elements thereon, said hook elements and said loops become interengaged to produce a significant degree of securement therebetween for joining components of said seat.

7. A female receiver means as defined in claim 6 wherein said loop density is in a range of from about 100 to 700 loops per square inch and wherein said scrim fabric was matched with the knit structure being produced thereabout so that said loops are located in the interstices thereof.

8. A female receiver means as defined in claim 7 wherein said scrim fabric includes approximately 25 warp threads per inch and approximately 14 weft threads per inch.

* * * * *